United States Patent [19]

Hudson et al.

[11] Patent Number: 4,987,829

[45] Date of Patent: Jan. 29, 1991

[54] PERFORATOR/CRUSHER FOR PLASTIC BOTTLES

[75] Inventors: Wilbur G. Hudson, Columbus; Ronald F. Schley, Hamilton; Joseph Tehrani, Columbus, all of Ga.

[73] Assignee: Lummus Development Corp., Columbus, Ga.

[21] Appl. No.: 414,772

[22] Filed: Sep. 29, 1989

[51] Int. Cl.[5] ..... B30B 15/30; B30B 5/04

[52] U.S. Cl. ..... 100/45; 100/48; 100/53; 100/95; 100/98 R; 100/137; 100/151; 100/153; 241/99; 241/200

[58] Field of Search ..... 100/45, 48, 49, 53, 100/94–96, 98 R, 137, 138, 139, 151, 152, 153, 902; 241/200, 99

[56] References Cited

U.S. PATENT DOCUMENTS

| | | | |
|---|---|---|---|
| 276,413 | 4/1883 | Hull et al. | 100/153 X |
| 1,656,063 | 1/1928 | Harrison | 100/95 X |
| 3,077,827 | 2/1963 | Bunke et al. | 100/151 X |
| 3,645,199 | 2/1972 | Kanna | 100/152 X |
| 3,691,942 | 9/1972 | Wagley | 100/151 |
| 3,776,128 | 12/1973 | Morris | 100/137 X |
| 4,261,259 | 4/1981 | Beardslee | 100/152 |
| 4,418,594 | 12/1983 | Burns, Jr. | 100/902 X |
| 4,501,198 | 2/1985 | Johansson et al. | 100/151 X |
| 4,735,367 | 4/1988 | Brutosky | 100/151 X |

FOREIGN PATENT DOCUMENTS

| | | | |
|---|---|---|---|
| 228371 | 7/1963 | Austria | 100/94 |
| 1257394 | 12/1971 | United Kingdom | 100/902 |

*Primary Examiner*—Philip R. Coe
*Assistant Examiner*—Stephen F. Gerrity
*Attorney, Agent, or Firm*—Jennings, Carter, Thompson & Veal

[57] ABSTRACT

A densification apparatus for use in recycling plastic containers utilizes a hopper with a movable lid to feed collected plastic containers to a continuous chain conveyor having a plurality of wedge-shape teeth which perforate the containers and urge them between a set of compression plates and rollers such that the plastics are compressed beyond their ability to resume their original shape. The vertical conveyor and hopper-closing lid prevent ballistic rejection of containers and enable iterative processing of plastic in a movable or stationary curbside apparatus.

18 Claims, 4 Drawing Sheets

PERFORATOR/CRUSHER FOR PLASTIC BOTTLES

FIELD OF THE INVENTION

The present invention relates to the field of recycling and particularly to the recycling of plastic products. In greater particularity the present invention relates to apparatus for reducing the volume of plastic containers at the collection site.

BACKGROUND OF THE INVENTION

It is becoming increasingly apparent that recycling of the by-products of society will eventually become a necessary way of life. One aspect of the recycling program is the recycling of plastic containers including those made of HDPE and PET, i.e. plastic bottles. Simple observation indicates that such pliant yet resilient containers have a disproportionate volume to weight ratio when contained in refuse. Accordingly, it is obvious that densification at the earliest stage of recycling is desirable. While household densification may not be feasible, curbside densification would prove quite beneficial to municipal collection of recyclables. Heretofore in the art, numerous devices have been disclosed for crushing metals cans. Exemplary of these are U.S. Pat. No. 3,077,827; U.S. Pat. No. 3,645,199; U.S. Pat. No. 3,691,942; U.S. Pat. No. 3,776,128; U.S. Pat. No. 4,261,259; and U.S. Pat. No. 4,501,198. Plastic containers are more resilient than metal cans and quite often this characteristic is amplified by the fact that the caps are replaced on the container when it is discarded. When this condition occurs, the plastic container must be perforated (ruptured) to permit the air to escape prior to crushing. Thus the plastic containers are frequently ejected from the input end of the prior art devices and thus present somewhat of a hazard, particularly if the device is used at a curbside location. Also, incomplete crushing or failure of the perforator is more likely to be a problem with plastic containers. It is also desirable that a curbside unit be portable and operative iteratively to permit safe, yet efficient, operation. Many of the prior art devices do not lend themselves to such utilization.

SUMMARY OF THE INVENTION

It is the object of the present invention to densify plastic components of household refuse.

Another object of the invention is to provide a means of perforating or puncturing plastic containers thus eliminating the need to remove caps prior to crushing.

Another object of the invention is to densify plastic containers for recycling as part of the collection process.

Yet another object of the invention is to provide a densification apparatus that is portable and can be readily affixed to a collection vehicle.

These and other objects and advantages of our invention are readily achieved by our novel combination of elements specifically adapted to address the problems of curbside densification of resilient plastic containers. Our densification apparatus should be small enough to be portable, yet durable and safe for use at a curbside location. One feature of significant concern in densification of plastic bottles is spontaneous rejection of the plastic bottle at the input side of the densifier apparatus. It will be appreciated that the bottle thus becomes a projectile which constitutes a hazard to the user of the machine or bystanders. In our apparatus, spontaneous rejection is eliminated by use of a lid which covers a hopper wherein the containers to be densified are deposited. A toothed chain conveyor, which is utilized to perforate, transport, and partially densify the containers, extends within the hopper, however movement of the chain can occur only when the lid is in position to prevent rejection of the containers and to urge the containers toward the chain conveyor.

The lid moves toward the conveyor until all of the containers have been urged against the conveyor where a plurality of triangular teeth perforate and engage the containers to entrain them with the motion of the conveyor. When all of the containers have been removed from the hopper, the conveyor stops and the lid returns to the open position to refill the hopper. In this manner, the apparatus assures that no container can be ejected from the input hopper.

Additionally, although precompression is effected between the conveyor and the rear wall of the hopper, final compression is effected between a pair of output rollers which are located well downstream of the hopper and which cannot reject a container through the hopper.

The specific design of our densification apparatus is particularly suited to use on recycling trucks in that the conveyor may be oriented such that it lifts the containers from the bottom of the hopper to a selected height. Thus, the work crew loading bottles may work at a comfortable level while filling the truck.

BRIEF DESCRIPTION OF THE DRAWINGS

Apparatus embodying features of our invention are depicted in the accompanying drawings which form a portion of this disclosure and wherein.

DESCRIPTION OF A PREFERRED EMBODIMENT

Figure 1:
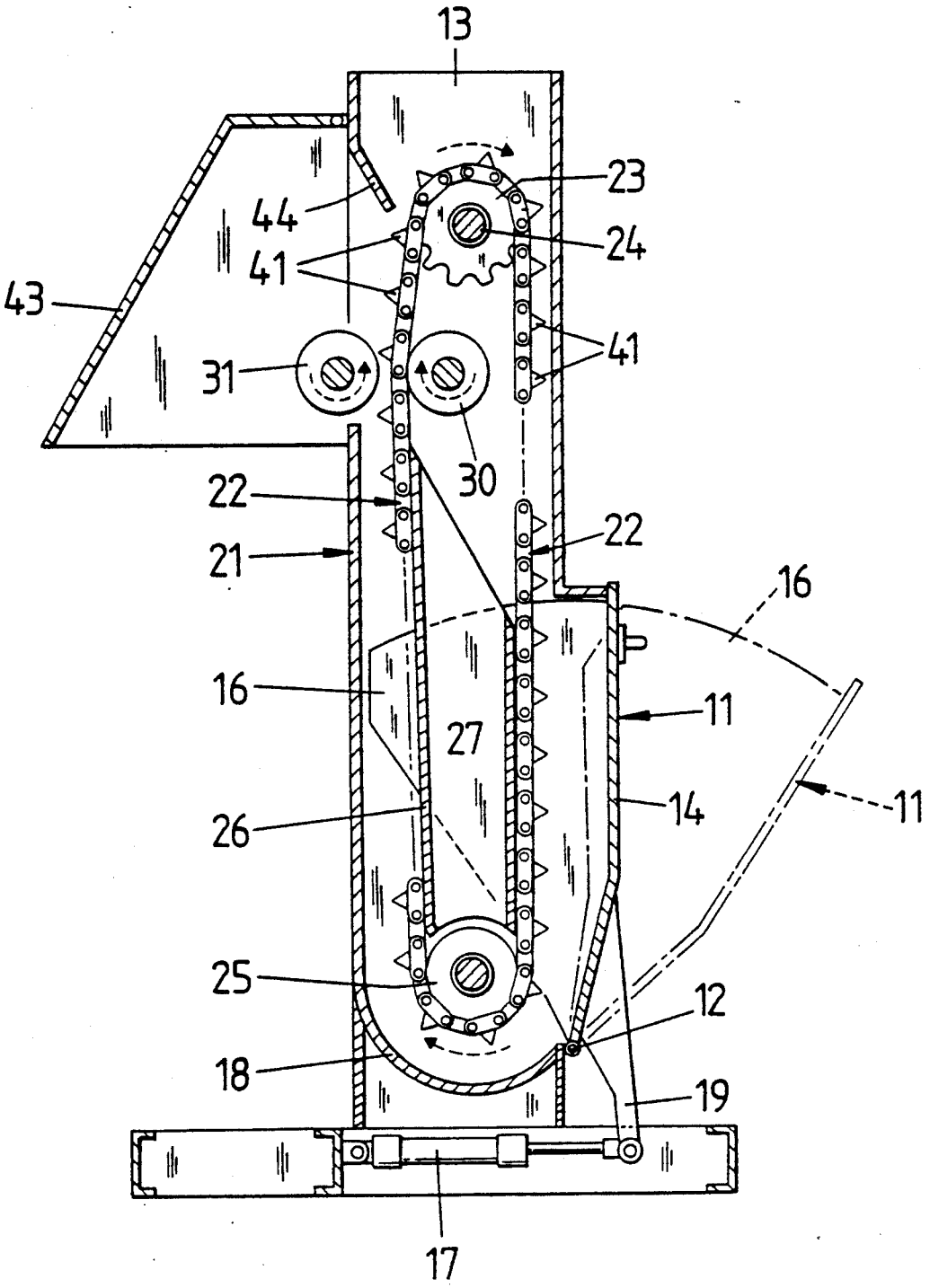
FIG. 1 is a side elevational view of a first embodiment of our apparatus partially in section.

Referring to the drawings for a clearer understanding of the invention, it may be seen in FIG. 1 that the first embodiment of the invention utilizes a voluminous door 11 which rotates upon a horizontal axis 12, located on the outside surface of the frame 13. The voluminous door 11 includes a back plate 14, which is attached to the horizontal axis 12, and a pair of side plates 16, connected to and extending perpendicular to the lateral edges of the back plate 14.

The voluminous door 11 rotates away from the frame 13 in a clockwise direction as viewed in FIG. 1 to an open position designated by a predetermined extension of a fluid-operated piston and shaft assembly 17 which actuates this clockwise and reciprocal counterclockwise motion of the voluminous door 11. The piston and shaft assembly 17 is pivotally connected to the door 11 by a counterarm 19. Of course the voluminous door 11 can be actuated manually or by electric rotary shaft motors, as is well known in the art. The horizontal axis 12 is located adjacent to a scroll 18 which in turn is mated to a compression wall 21 which extends opposite the voluminous door 11.

Intermediate the voluminous door 11 and the compression wall 21 is a continuous chain conveyor 22 mounted for driven rotation on a set of drive sprockets 23 mounted on a shaft 24 supported in the frame 13 which extends upwardly above the chain conveyor 22 The frame 13 also supports a bottom idler roller 25 about which the chain conveyor 22 is driven. The bottom idler roller 25 is spaced from the scroll 18 and compression wall 21. A pair of support plates 26 and 27 extend upwardly from adjacent the bottom idler roller 25 to provide support for the chain conveyor 22. Thus the chain conveyor 22 passes between plate 26 and the compression wall 21. The compression wall 21 extends upwardly approximately one-half the height of the chain conveyor 22. Mounted directly above the top of the compression wall 16 are a pair of compression rollers 30 and 31. Inner plate 26 is aligned substantially longitudinally with roller 30 which is an idler roller mounted in frame 13 and compression wall 21 is aligned substantially longitudinally with roller 31 which is a driven roller. As may be seen most clearly in FIG. 1, the space between the compression plate 21 and plate 26 narrows from the bottom idler roller 25 to the compression rollers 30 and 31, thus these rollers are more closely spaced than the plates 21 and 26.

Figure 4:
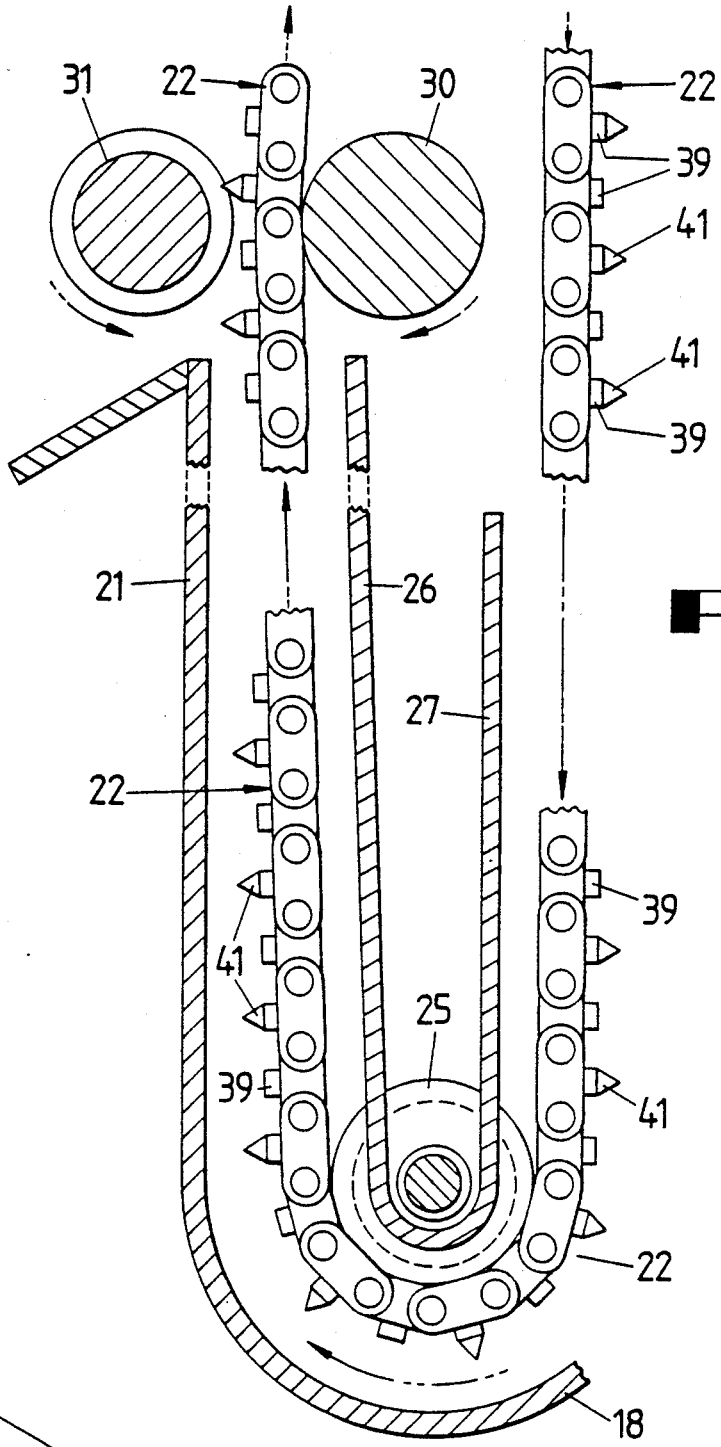
FIG. 4 is a detailed sectional view showing the compression area of the apparatus.
Figure 5:
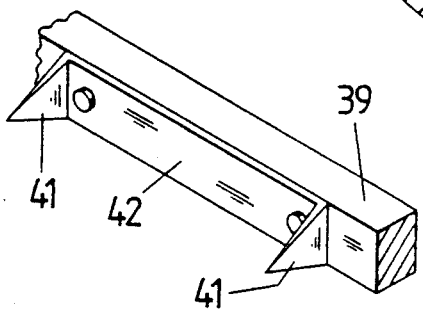
FIG. 5 is a detail perspective view of the perforator teeth.

It should be noted, and as is shown in FIGS. 4 and 5, that the chain conveyor 22 carries thereon a plurality of transversely aligned crush bars 39 which alternately carry a number of wedge-shaped teeth 41 which are formed in pairs on mounting brackets 42. Each tooth 41 tapers to a point and readily perforates the plastic containers; however, the containers are easily dislodged therefrom after they pass through the compression rollers 30 and 31. It is also clear that the extension of the teeth 41 from the chain conveyor defines the minimum separation between the plates 21 and 26 as well as the rollers 30 and 31. The driven roller 31 may be moved laterally to vary the spacing between the rollers, however such variation is not normally necessary.

Above the rollers 30 and 31, the frame 13 is open on the side adjacent the compression plate 21 and has a discharge shroud 43 extending downwardly and outwardly therefrom. The side of the frame above the pivotal mounting of voluminous door is closed to prevent inadvertent contact with the chain conveyor. A deflector plate 44 is positioned on the open side of the frame 13 proximal the drive sprocket 23 to dislodge any containers which might be carried upwardly on the teeth 41 to the region of the sprockets 23.

Note that the chain conveyor 22 and driven roller 31 may be driven by a single motor 45 or a plurality of motors as may be convenient in the application. Regardless of the number of motors used, a proximity switch 50 is positioned near the horizontal axis 12 of the voluminous door 11 such that when the door 11 is in a fully open position, the motors are not engaged. Preferably the motors will only be operating to move the chain conveyor 22 when the door 11 is being urged inwardly toward the frame 13 and will be stopped when the door 11 is urged outwardly to an open position.

In operation, plastic containers are first separated from the remainder of the refuse for recycling and are deposited in the voluminous door 11 while in an open position. The door is urged toward the chain conveyor 22 when the conveyor is activated. The pressure applied by the fluid-operated piston and shaft assembly 17 urges the containers against the teeth 41 which perforate the containers and pull them along with the conveyor 22 between the plate 26 and compression wall 21 such that the air in the containers is forced out through the perforation and the containers are destructively deformed As the containers then pass through the rollers 30 and 31 the reinforced neck area of each container is compressed and the entire container is compressed beyond its resilient limits such that upon exiting from between the rollers, the natural resiliency of the plastic is insufficient to return the container to its original shape. In practice, such densification has resulted in a reduction in volume of approximately 75% over unreduced containers. As may be seen in FIG. 2, the location of the voluminous door 11 and the discharge area permits easy loading and densification of the plastic products in a mobile unit. Thus we have provided a practical and efficient solution to curbside densification of plastic containers.

Figure 3:
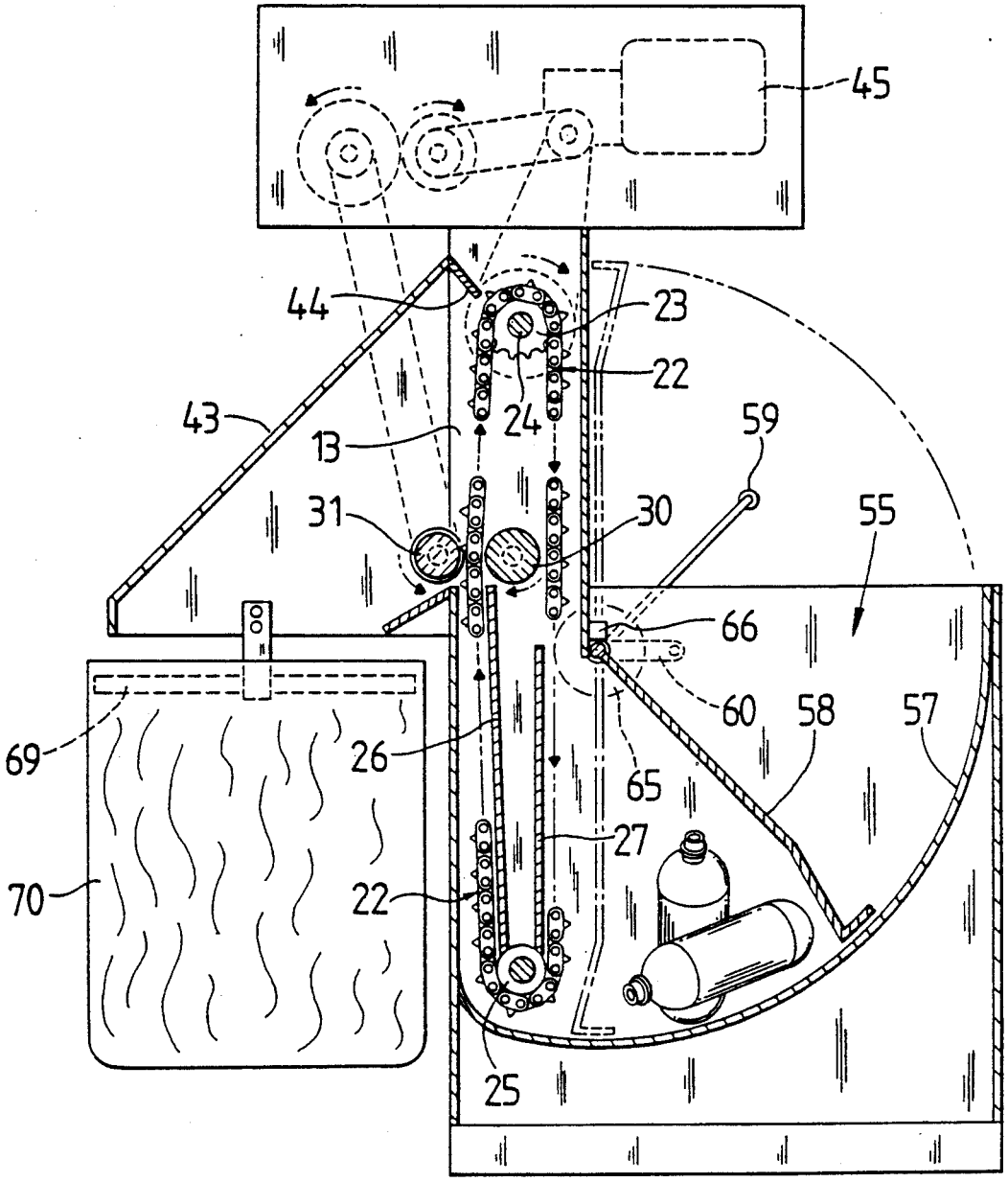
FIG. 3 is a side elevational view of a second embodiment of our apparatus partially in section.

It may be seen in FIG. 3 that the second embodiment of the invention utilizes a hopper 55 defined by a pair of sidewalls 56 and a curved feed wall 57. The feed wall 57 is affixed to the scroll 18 and provides a continuous slide for contact of the plastic containers with the chain conveyor 22.

Pivotally mounted to and extending between the sidewalls 56 is a weighted lid 58 which is movable between a fully raised position, shown in dotted line, and a fully lowered position within the hopper 55. The lid 58 has an operating handle 59 which facilitates raising and lowering thereof and a latch strap 60, both of which rotate with the lid 58 and have a fixed angular relation thereto. In the embodiment shown in FIG. 3, the lid may be mechanically raised and lowered, as with a hydraulic actuator 65 which may be a suitable rotary drive coupled to the lid.

An activation switch 66 is positioned near the pivot axis of the lid 58 such that when the lid 58 is open the motor 45 is not engaged. Preferably the motor 45 will only be operating to move the chain conveyor 22 while the lid 58 is within the hopper 55 and will be stopped when the lid 58 is outside the hopper 55.

In operation, plastic containers are first separated from the remainder of the refuse for recycling and are deposited in the hopper 55. When the hopper 55 is full, retaining strap 60 is detached from its normal affixation to frame 13 to permit the lid 58 to be lowered. As the lid 58 becomes horizontal and covers the top of the hopper 55, the proximity switch 66 is engaged to energize the chain conveyor 22. The weight of the lid 58 urges the container against the teeth 41 which perforate the containers and pull them along with the conveyor 23, thereby perforating and destructably deforming the containers as previously mentioned in the first embodiment.

Figure 2:
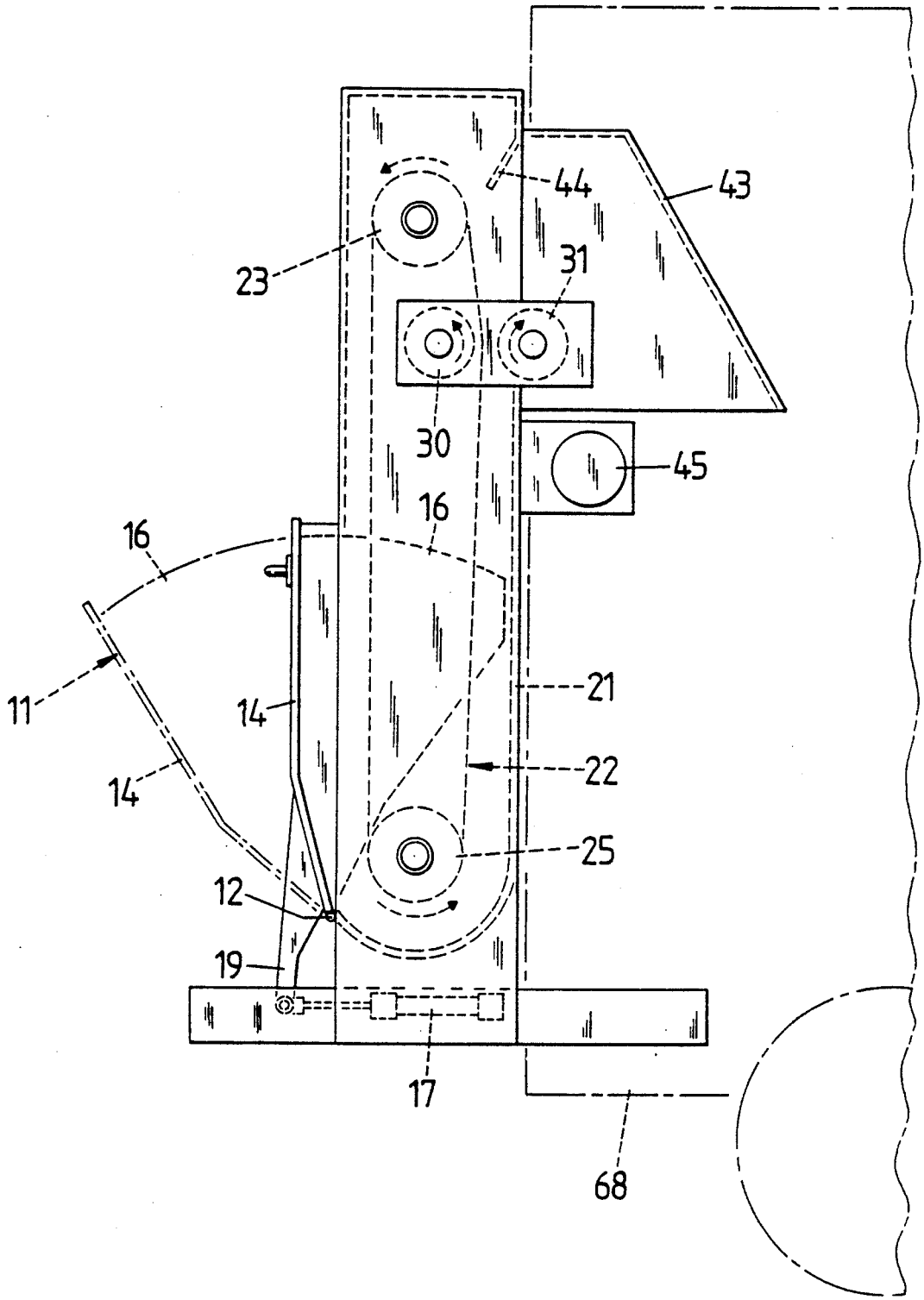
FIG. 2 is a side elevational view taken from the side opposite FIG. 1.

As shown in FIG. 2 the apparatus can be mounted to the rear of a collection truck 68 or may be placed at a fixed collection point, as seen in FIG. 3. If located at a fixed point, the discharge chute includes means 69 for positioning a bag 70 or other container to receive the densified plastic.

While we have shown our invention in two forms, it will be obvious to those skilled in the art that it is not so limited but is susceptible of various changes and modifications without departing from the spirit thereof.

What we claim is:

1. Apparatus for reducing resilient containers, such as plastic bottles, for recycling and the like comprising:

(a) an elongated chain conveyor having a plurality of wedge-shaped teeth thereon for perforating and engaging resilient containers;

(b) a compression plate mounted adjacent said chain conveyor in converging relation thereto defining a vertical wall;

(c) means for compressing said containers subsequent to compression between said compression plate and said chain conveyor, wherein said compression means is characterized by an idler roller mounted at a fixed position relative to said chain conveyor and transversely thereto, within the rotation thereof and urging said chain conveyor toward said compression plate; and a driven roller mounted parallel to and proximal said idler roller with said chain conveyor passing between said idler roller and said driven roller; and means for selectively positioning said rollers to vary the space therebetween; and (d) means for urging a predetermined volume of resilient containers toward said chain conveyor.

2. Apparatus as defined in claim 1 wherein said means for urging comprises a voluminous door pivotally mounted proximal said conveyor and forming a chamber with said compression plate and movable about a horizontal axis toward said compression plate, thereby confining said containers into said chamber and subsequently sealing said chamber to prevent ejection of said containers.

3. Apparatus as defined in claim 2 further comprising drive means for driving said chain conveyor and means for selectively activating said drive means responsive to the position of said voluminous door.

4. Apparatus as defined in claim 2 further comprising drive means for selectively moving said chain conveyor responsive to the position of said means for urging.

5. Apparatus for reducing resilient containers, such as plastic bottles, for recycling and the like characterized by:

(a) a hopper for receiving said containers for perforation in a batch or continuous mode;

(b) an elongated chain conveyor positioned within said hopper and extending therefrom, having a plurality of wedge-shaped teeth thereon for perforating and engaging said containers within said hopper;

(c) a compression plate mounted adjacent said chain conveyor in converging relation thereto defining a vertical wall of said hopper; and (d) means for compressing said containers subsequent to compression between said compression plate and said chain conveyor, wherein said compression means comprises an idler roller mounted at a fixed position relative to said chain conveyor and transversely thereto, within the rotation thereof and urging said chain conveyor toward said compression plate; and a driven roller mounted parallel to and proximal said idler roller with said chain conveyor passing between said idler roller and said chain conveyor; and means for selectively positioning said rollers to vary the space therebetween.

6. Apparatus as described in claim 5 comprised of a means for urging containers within said hopper toward said chain conveyor.

7. Apparatus as defined in claim 6 wherein said means for urging comprises a plate-like member pivotally mounted to said hopper proximal said chain conveyor and movable therewithin to reduce the volume of said hopper.

8. Apparatus as defined in claim 7 further comprising drive means for driving said chain conveyor and means for selectively activating said drive means responsive to the position of said plate-like member relative to said hopper.

9. Apparatus as defined in claim 8 wherein said hopper includes a curved feed wall extending upwardly from beneath said conveyor and a pair of generally planar sidewalls extending from said compression plate, proximal said conveyor, to said feed wall.

10. Apparatus as defined in claim 9 further comprising drive means for selectively moving said chain conveyor responsive to the position of said means for urging relative to said hopper.

11. Apparatus as defined in claim 6 further comprising drive means for selectively moving said chain conveyor responsive to the position of said means for urging such that said conveyor is iteratively driven to remove a selected volume of containers from said hopper.

12. Apparatus for reducing the volume of a quantity of plastic bottles comprising:

(a) a hopper having a lid pivotally mounted transversely of said hopper for containing said quantity of plastic bottles;

(b) a continuous chain conveyor having a longitudinal axis extending within said hopper and positioned proximal said lid;

(c) a plurality of teeth affixed to said chain conveyor and extending normally thereto for perforating and entraining said plastic bottles and (d) a pair of compression rollers each mounted adjacent said hopper with one of said compression rollers in selectively adjustable fixed relation to the other compression roller of said pair of compression rollers with said chain conveyor and associated teeth passing therebetween, with said lid being movable within said hopper to force said bottles into perforating engagement with said teeth such that said bottles are entrained by said chain conveyor and compressed between said rollers.

13. Apparatus as defined in claim 12 further comprising drive means for selectively driving said chain conveyor responsive to downward movement of said lid within said hopper.

14. Apparatus as defined in claim 13 wherein said drive means comprises:

(a) a motor operably connected to said chain conveyor for driving said conveyor about a continuous path; and (b) switch means for actuating said motor when said lid is moving within said hopper toward said chain conveyor in said hopper.

15. Apparatus as defined in claim 12 further comprising a compression plate defining a wall of said hopper adjacent said movable portion of said chain conveyor such that bottles lifted by said chain conveyor are compressed thereagainst.

16. Apparatus as defined in claim 15 wherein said compression rollers include an idler roller mounted within said continuous chain conveyor and urging said conveyor toward said compression wall; and, a driven roller mounted in spaced relation to said idler roller, adjacent said compression wall.

17. Apparatus as defined in claim 12 wherein said teeth are mounted on carrier bars affixed to said chain conveyor and extending transversely thereof.

18. Apparatus as defined in claim 17 wherein said teeth are triangular in shape with minimal thickness and are aligned with the vertical axis of said chain conveyor.

* * * * *